US007185626B2

(12) United States Patent
Huckelberry et al.

(10) Patent No.: US 7,185,626 B2
(45) Date of Patent: Mar. 6, 2007

(54) FUEL VAPORIZATION SYSTEM

(76) Inventors: Cynthia Huckelberry, 1400 Barton Rd., #2104, Redlands, CA (US) 92373; Peter John Rienks, 25225 Cottage St., Loma Linda, CA (US) 92354

( * ) Notice: Subject to any disclaimer, the term of this patent is extended or adjusted under 35 U.S.C. 154(b) by 0 days.

(21) Appl. No.: 11/195,481

(22) Filed: Aug. 2, 2005

(65) Prior Publication Data

US 2006/0048745 A1 Mar. 9, 2006

Related U.S. Application Data

(60) Provisional application No. 60/607,715, filed on Sep. 8, 2004.

(51) Int. Cl.
*F02M 29/02* (2006.01)
*F02M 29/06* (2006.01)

(52) U.S. Cl. ..... 123/306; 123/592; 261/79.2

(58) Field of Classification Search ..... 123/306, 123/590, 591, 592; 60/243; 48/189.5; 138/37, 138/39; 261/79.1, 79.2
See application file for complete search history.

(56) References Cited

U.S. PATENT DOCUMENTS

| | | | | |
|---|---|---|---|---|
| 575,049 | A | 1/1897 | Bernd, Jr. | |
| 787,254 | A | 4/1905 | Young | |
| 942,503 | A | 12/1909 | Jacobs | |
| 1,578,262 | A * | 3/1926 | Campbell | 48/189.5 |
| 2,093,918 | A * | 9/1937 | Lord, Jr. | 48/189.5 |
| 2,745,372 | A | 5/1956 | Chertoff | |
| 2,784,069 | A | 3/1957 | Falzone | |
| 3,615,296 | A | 10/1971 | Guarnaschelli | |
| 3,822,868 | A | 7/1974 | Carnes | |
| 3,945,361 | A | 3/1976 | Piotrowicz, Sr. | |
| 3,952,716 | A | 4/1976 | McCauley | |
| 4,021,512 | A | 5/1977 | Kaufman | |
| 4,059,082 | A | 11/1977 | McCauley | |
| 4,080,943 | A * | 3/1978 | Carr et al. | 123/592 |
| 4,087,491 | A | 5/1978 | Chapin | |
| 4,263,235 | A | 4/1981 | Holzbaur et al. | |
| 4,314,951 | A | 2/1982 | Holzbaur et al. | |
| 4,399,800 | A | 8/1983 | Weindelmayer | |
| 4,422,432 | A * | 12/1983 | Knox, Sr. | 123/592 |
| 4,478,607 | A | 10/1984 | Capps | |
| 4,537,173 | A | 8/1985 | Norris | |
| 5,231,963 | A | 8/1993 | Perkins | |
| 5,569,017 | A * | 10/1996 | Barnhart et al. | 415/177 |
| 5,638,797 | A | 6/1997 | Kim | |
| 6,179,559 | B1 * | 1/2001 | Weaver | 415/161 |
| 6,550,446 | B1 * | 4/2003 | Robley, Jr. | 123/306 |
| 6,584,963 | B2 * | 7/2003 | Arnold | 123/559.1 |

* cited by examiner

*Primary Examiner*—Andrew M. Dolinar
*Assistant Examiner*—Johnny H. Hoang
(74) *Attorney, Agent, or Firm*—Knobbe, Martens, Olson & Bear LLP

(57) ABSTRACT

A system and devices to actively induce turbulent flow in the intake tract of an internal combustion engine. At least certain of the devices include moving components which induce a swirling or rotating movement about a major intake axis. The adjustment to the flow provides more complete atomization or vaporization of liquid fuel components in an incoming fuel air mixture. Individual devices can be provided in individual intake runners. A single device can be provided in the plenum region of integral or monolithic intake manifolds. Rotation axes of rotating flow diverters can be inclined to also provide a tumbling or rolling component to the mixture flow. Inclined vanes of non-moving flow adjusters can also be provided to induce a tumbling flow component.

9 Claims, 6 Drawing Sheets

FUEL VAPORIZATION SYSTEM

CROSS-REFERENCE TO RELATED APPLICATIONS

This application claims the benefit of U.S. Provisional Application No. 60/607,715 filed Sep. 8, 2004 entitled "Fuel Vortex".

BACKGROUND OF THE INVENTION

1. Field of the Invention

The invention relates to the field of internal combustion engines for motor vehicles and, more particularly, to devices that improve vaporization of liquid fuels.

2. Description of the Related Art

Internal combustion engines are utilized in a wide variety of motor vehicles including passenger cars and trucks, boats, aircraft, motorcycles, and recreational vehicles, as well as in a variety of home, commercial, and/or agricultural vehicles and implements. Internal combustion engines operate generally as air pumps by drawing in a quantity of atmospheric air, combining fuel with the air, and initiating a controlled combustion of the fuel/air mixture in a contained manner such that the heat and pressure of the combustion process can be converted to work energy. Three fairly common types of internal combustion engines, known generally as 4 stroke or Otto cycle reciprocating engines, 2 stroke reciprocating engines, and Wankel type rotary engines, utilize gasoline, alcohol, or other relatively volatile liquid fuels and initiate the combustion process by providing a temporary electrical arc or spark. While these types of engines represent a well developed technology, they all suffer the relative disadvantage of fairly inefficient conversion of the available heat energy in the fuel/air mixture to useful work energy as a significant fraction is lost as waste heat energy.

As fuel, such as gasoline, used in internal combustion engines is a relatively expensive commodity, it is desirable that the conversion process of available heat energy to useful work energy be made more efficient. Thus, there is a need to increase the efficiency of the internal combustion process to reduce fuel costs and to extend the range or operating time of an engine for a given quantity of fuel.

SUMMARY OF THE INVENTION

The invention is based in part on the concept of improving the efficiency of internal combustion engines by more effectively promoting vaporization of a liquid fuel, such as gasoline. When the liquid fuel is mixed with incoming air, more complete vaporization of the liquid improves efficiency of the induced combustion process. Aspects of the invention strive to adjust air flow in the internal combustion engine to provide flow characteristics more conducive to complete vaporization of the liquid fuel before the combustion process is initiated.

One embodiment comprises a fuel vaporization system for an internal combustion engine comprising an intake tract configured for connection to an engine, at least one fuel metering device connected to the intake tract and receiving air and metering fuel such that a flow of fuel and air mixture is delivered to the engine via the intake tract along a flow axis, and one or more flow adjusters having one or more moving components arranged with respect to the intake tract such that the one or more flow adjusters actively induce a swirl component about the flow axis to the flow of fuel and air mixture to improve vaporization of the fuel in the fuel and air mixture.

Another embodiment comprises a flow adjuster for an internal combustion engine comprising a support housing having an outer surface configured to be connected with an intake tract of an internal combustion engine, at least one annular bearing having an outer race which is attached to an inner surface of the support housing, the at least one bearing also having an inner race, and a plurality of vanes attached to the inner race and arranged so as to define a plurality of angled faces and wherein the plurality of vanes and the inner race together define a rotating mass having a rotational inertia and wherein a flow of a fuel and air mixture through a central opening of the support housing will impinge on the plurality of angled faces so as to provide a rotational acceleration of the rotating mass to improve vaporization of the fuel in the fuel and air mixture.

Yet another embodiment comprises a flow adjuster for an internal combustion engine comprising a support housing configured to be connected with an intake tract of an internal combustion engine along a flow axis and defining a generally annular opening with a center web, an axle mounted to the center web, at least one bearing mounted to the axle, and at least one rotatable flow diverter connected via the at least one bearing to the axle wherein a flow of a fuel and air mixture through the opening of the support housing will provide a rotational acceleration of the rotating mass and a swirling component to the flow to improve vaporization of the fuel in the fuel and air mixture. These and other objects and advantages of the invention will be more apparent from the following description taken in conjunction with the accompanying drawings.

DETAILED DESCRIPTION OF THE PREFERRED EMBODIMENTS

Figure 1:
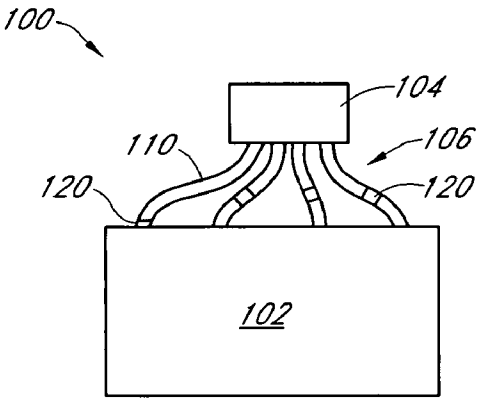
FIG. 1 is a schematic illustration of one embodiment of a fuel vaporization system as fitted to a first configuration of engine.

Reference will now be made to the drawings wherein like reference numerals refer to like parts, structures, and/or processes throughout. It should be understood that the figures are schematic in nature indicating generally the structural relationships and operating principles of various embodiments of the invention, however, should not be interpreted as being to scale. FIG. 1 illustrates one embodiment of a fuel vaporization system 100 which is configured to improve the vaporization or atomization of liquid fuel in an internal combustion engine 102. In various embodiments, the internal combustion engine 102 can comprise a single or multi-cylinder 4-stroke or Otto cycle engine. In other embodiments, the internal combustion engine 102 comprises a single or a multi-cylinder 2-stroke reciprocating engine. In yet other embodiments, the internal combustion engine 102 comprises a single or multiple rotor Wankel type rotary engine. The internal combustion engines 102 utilize a relatively volatile fuel which can comprise one or more of gasoline, alcohol such as methanol and/or ethanol, and/or nitromethane. Various embodiments of the internal combustion engine 102 may utilize the liquid fuel in a substantially pure state and, in yet other embodiments, the liquid fuel comprises at least certain additives, such as a premixed lubricating oil for the internal combustion engine 102. Various embodiments of the internal combustion engines 102 are suitable for use as motive power units for motor vehicles, such as motorcycles, recreational vehicles, automobiles, trucks, boats, and/or aircraft, as well as to provide power for home, commercial, and/or agricultural implements, as well as stationary power units.

The system 100 comprises one or more fuel metering devices 104. The fuel metering device(s) 104 provide a controlled or metered amount of liquid fuel to the internal combustion engines in accordance with the particular operating conditions of the internal combustion engine. For example, the fuel metering device 104 has one or more control and/or feedback mechanisms indicative of the quantity of fuel required for proper operation of the internal combustion engine 102 under a variety of operating conditions. The fuel metering devices 104 generally provide an increased amount of fuel as the operating speed of the internal combustion engine increases or as the output power required from the internal combustion engine 102 increases. Conversely, the fuel metering devices 104 typically reduce or restrict the quantity of fuel provided to the internal combustion engine as the operating speed of the internal combustion engine 102 slows or the power demands from the engine 102 are reduced.

The fuel metering devices 104 comprise, in various embodiments, structures known generally as carburetors and/or fuel injection systems whose construction and operating principles are otherwise conventional and well understood by one of ordinary skill. The fuel metering devices 104 also comprise, in certain embodiments, forced induction systems such as turbo-chargers and/or superchargers. In certain embodiments, the fuel metering devices 104 comprise supplemental metering capability, such as nitrous oxide and supplemental fuel metering and/or alcohol/water injection. It is at least partially an object of various embodiments of the invention to improve the efficiency with which the fuel metering devices 104 ultimately provide fuel to the internal combustion engine 102 such that for a given operating condition of the engine 102, relatively less fuel is provided by the fuel metering device 104 when employing one or more embodiments of the system 100 as described herein.

FIG. 1 also illustrates that this embodiment of the system 100 also comprises an intake tract 106 which receives air and is interconnected with the fuel metering device 104 and thus to the internal combustion engine 102. In this particular embodiment, the intake tract 106 comprises a plurality of individual runners 110 which are interposed between and interconnect the fuel metering device 104 to the internal combustion engine 102. In this embodiment, the individual runners 110 are generally tubular elongate members which convey a mixture of atmospheric air with fuel provided by the fuel metering device 104 for subsequent combustion by the internal combustion engine 102 for conversion to useful work. In this embodiment, each of the individual runners 110 of the intake tract 106 is provided with one or more flow adjusters 120. The flow adjusters 120 are positioned in the interior of each individual runner 110. The flow adjusters 120 operate to adjust the flow of the fluid mixture of air and fuel which is being provided to the internal combustion engine 102. The flow adjusters 120 facilitate the vaporization of the fuel which is initially provided at least partially in a liquid state to an atomized or vapor phase for combustion in the internal combustion engine. This process will be described in greater detail below.

Figure 2:
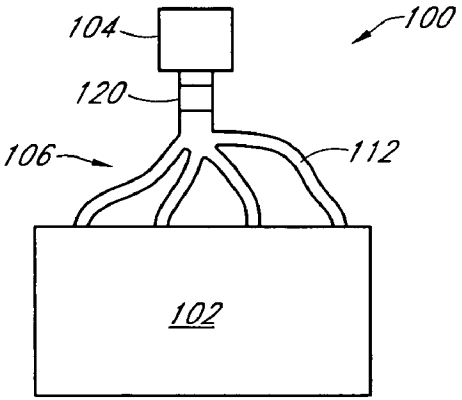
FIG. 2 is a schematic illustration of another embodiment of a fuel vaporization system as fitted to a second configuration of engine.

FIG. 2 illustrates another embodiment of a fuel vaporization system 100 which is substantially similar to the embodiments previously described with reference to FIG. 1, however with a different configuration of the intake tract 106. More particularly, in this embodiment, the intake tract 106 comprises a single manifold structure 112 which is of a single piece or integral nature. In this embodiment, the manifold 112 comprises a first end or plenum connected to the fuel metering device 104 which defines a single cavity or volume through which the fuel and air from the fuel metering device 104 passes. The manifold 112 further comprises an outlet or terminal end having one or more conduits connected to the internal combustion engine 102 such that the fuel/air mixture from the fuel metering device 104 is appropriately distributed for use in the internal combustion engine 102. Again, the particular configurations of an intake tract 106 comprising one or more individual runners 110 as illustrated in FIG. 1 or a single manifold 112 with one or more outlet or distribution points would vary depending upon the particular application, however, can be readily implemented by one of ordinary skill to suit the requirements and indications of particular applications.

A further difference of the embodiment of the system 100 illustrated in FIG. 2 is that a single flow adjuster 120 is provided in the manifold 112 and, in this embodiment, is positioned adjacent the fuel metering device 104. In contrast, in the embodiment of system 100 illustrated in FIG. 1, the flow adjusters 120 are positioned adjacent the internal combustion engine 102 rather than adjacent the fuel metering device 104. The particular placement of one or more of the flow adjusters 120 in the intake tract 106 can be selected or adjusted in various embodiments based on the particular operating parameters of the internal combustion engine 102 as well as the typical operating conditions. It should also be appreciated that certain embodiments may indicate that certain of the flow adjusters 120 be positioned proximal or adjacent the internal combustion engine 102, that one or more of the flow adjusters 120 be positioned proximal or adjacent the fuel metering device 104, and/or positioned generally at a medial or intermediate position between the internal combustion engine 102 and fuel metering device 104. In one embodiment, one or more flow adjusters 120 are interposed between the engine 102 and the intake tract 106. Selection of an appropriate position for the one or more flow adjusters 120 can be readily implemented by one of ordinary skill based on the requirements of particular applications.

Figure 3:
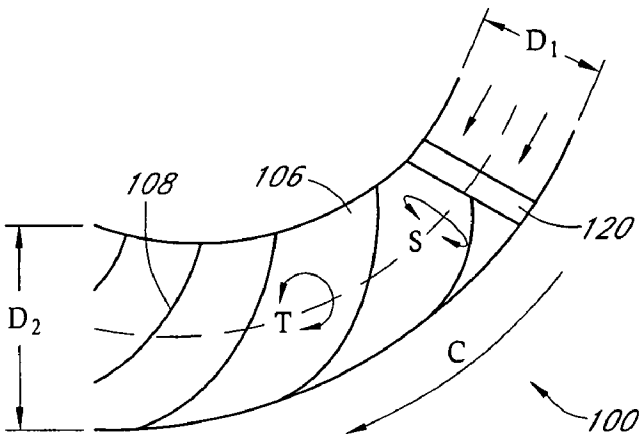
FIG. 3 is a side section view of one embodiment of a fuel vaporization device installed in one configuration of engine intake tract.

FIG. 3 illustrates in greater detail one embodiment of the flow adjustment provided by the flow adjusters 120. As can be seen in FIG. 3, the flow adjuster 120 is installed in the interior of the intake tract 106 so as to substantially completely span a flow passage in the interior of the intake tract 106. The flow adjuster 120 is configured such that a fluid flow, such as a mixture of air and fuel, can pass through the flow adjuster 120, in a manner to improve the vaporization or atomization of any liquid fuel remaining in the flow. More particularly, the flow adjuster 120 is configured and installed with respect to the configuration of the intake tract 106 such that as the air/fuel mixture passes through the flow adjuster 120, the mixture is induced to rotate or swirl about a swirl axis S extending generally along the major axis of the intake tract 106 and thus along the major axis of flow of the fuel/air mixture.

The fuel/air mixture is also directed to partially impinge on interior curved walls of the intake tract 106 in this embodiment. As the walls of the intake tract 106 are at least partially curved, the fuel/air mixture is induced to tumble or roll about a transverse axis T arranged generally transverse to the swirl axis S. In one embodiment, the interior walls of the intake tract 106 also define spiral grooves/lands arranged in a rifling arrangement 108. The rifling 108 further contributes to the swirl motion of the fuel/air mixture and to improved vaporization of any remaining liquid fuel. The rifling 108 can be positioned in a generally straight portion and/or a curved portion of the intake tract 106.

In this embodiment, the tumble motion component T provided to the fuel/air mixture flow is provided at least partially by the contour of the intake tract 106 which has a curvature C as the intake tract 106 is curved about an axis generally parallel with the transverse or tumble axis T. Thus, in this embodiment, a relatively uniform smooth fluid flow in the intake tract 106 which encounters the flow adjuster 120 is induced to both swirl about the swirl axis S as well as to tumble about a transversely extending tumble axis T. This adjustment to the flow in the intake tract 106 provided by the flow adjuster 120 as well as the contour or configuration of the intake tract 106 itself, causes at least a partial turbulent flow which more effectively mixes the fuel with the air to facilitate more complete vaporization of any remaining liquid fuel which may be in the fuel/air mixture entering the flow adjuster 120. This adjusted flow would then pass into the internal combustion engine 102 where the improved atomization or vaporization of the previously liquid fuel as mixed with the incoming air stream facilitates a more efficient combustion process in the internal combustion engine 102 to improve efficiency, fuel economy, and power.

Figure 4:
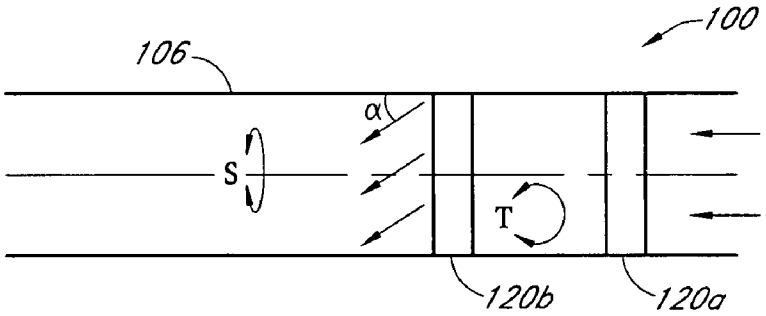
FIG. 4 is a side section view of another embodiment of a fuel vaporization device installed in another configuration of engine intake tract.

FIG. 4 illustrates in side section view another embodiment of a fuel vaporization system 100. In this embodiment, a plurality of flow adjusters 120*a* and 120*b* are installed in a substantially straight portion of an intake tract 106. In this embodiment, a first flow adjuster 120*a* is configured to receive a substantially straight and uniform incoming flow of a fuel/air mixture from the fuel metering device 104. The first flow adjuster 120*a* is configured to induce a tumbling or end-over-end movement component to the flow as indicated by the T rotation. After the flow passes the first flow adjuster 120*a*, the flow encounters a second flow adjuster 120*b*. The second flow adjuster 120*b* induces the flow to assume a swirling or vertical movement about the swirl axis S. Similarly, as in the embodiments of FIG. 3, the swirl axis is generally coincident with the major axis of this portion of the intake tract 106. The tumbling component provided by the first flow adjuster 120*a* is arranged at an angle $\alpha$ with respect to the swirl axis S. Thus, similarly as in the embodiment illustrated in FIG. 3 wherein the combined action of the flow adjuster 120 and the curvature C of the region of the intake tract 106, the outgoing flow from the flow adjusters 120*a* and 120*b* has both swirling and tumbling components to agitate and further atomize and vaporize any remaining liquid fuel components in the fuel/air mixture. The angle $\alpha$ can be readily adapted to the requirements of particular applications, however, it is found that generally angles between approximately 5 and 45 degrees provide particularly advantageous adjusted flow conditions.

Figure 5:
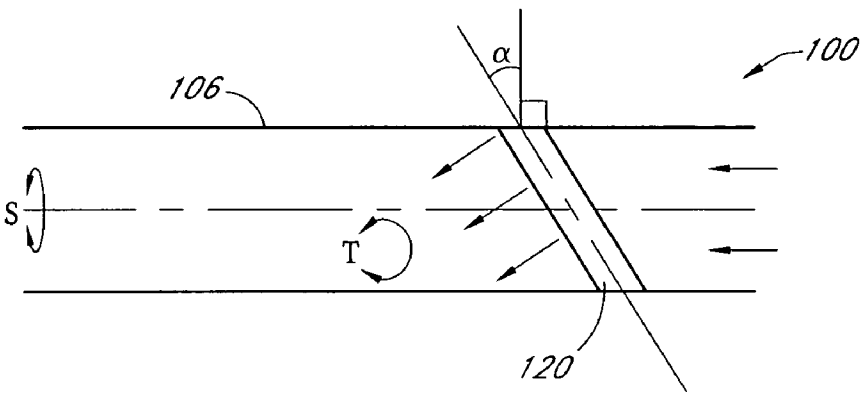
FIG. 5 is a side section view of a further embodiment of a fuel vaporization device installed in the configuration of engine intake tract shown in FIG. 4.

FIG. 5 illustrates yet another embodiment of a fuel vaporization system 100 wherein a single flow adjuster 120 is arranged in a relatively straight portion of the intake tract 106. In this embodiment, the single flow adjuster 120 is configured to induce a relatively straight uniform incoming fuel/air mixture flow to have both a swirling S and a tumbling T component to agitate and facilitate atomization or vaporization of any remaining liquid fuel components in the fuel/air mixture. In this embodiment, the single flow adjuster 120 is inclined at an angle $\alpha$ with respect to the flow axis.

Figure 8:
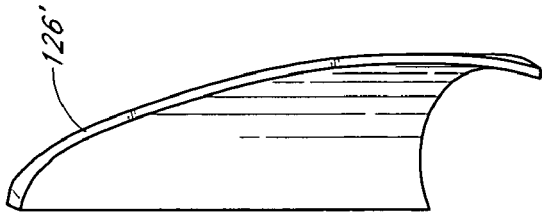
FIG. 8 is a perspective view of one embodiment of a diverting vane of a fuel vaporization device.
Figure 6:
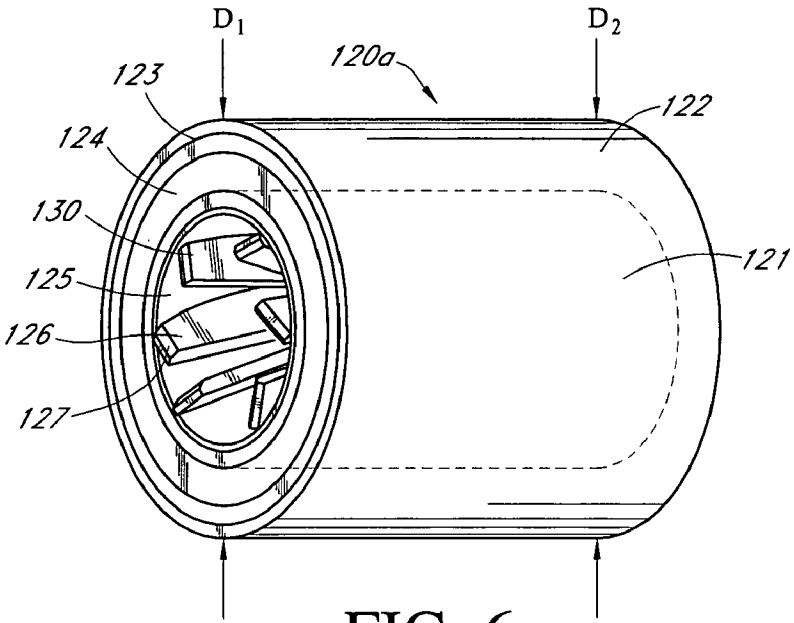
FIGS. 6 and 7 are perspective and end views respectively of one embodiment of a fuel vaporization device.
Figure 7:
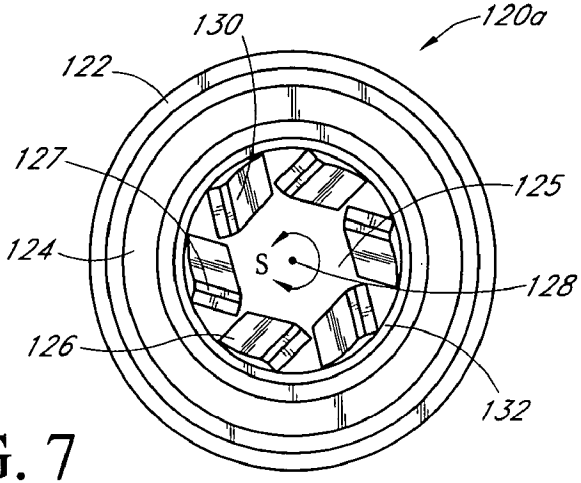

FIG. 6 illustrates in perspective view and FIG. 7 in side view one embodiment of a flow adjuster device 120. In this embodiment, the flow adjuster 120 comprises a generally cylindrical support housing 122. The support housing 122 is configured both for attachment in the interior of the intake tract 106 at an outer surface 121 of the support housing 122. An inner surface 123 of the support housing 122 is configured for attachment to one or more bearings 124. The bearings 124 are generally annular, bushing, ball or needle type bearings which define a generally circular inner opening 125. A plurality of diverting vanes 126 are attached to the inner surface 123 of the one or more bearings 124. In one embodiment, the vanes 126 comprise generally rectangular elongate structures which extend at least partially to a center 128 of the flow adjuster 120. In other embodiments, the vanes 126 are generally triangular (FIG. 8). In certain embodiments, the vanes 126 also comprise a curved configuration (FIG. 8). The vanes 126 are fixedly attached to an inner race of the one or more bearings 124 such that the inner race and attached vanes 126 can rotate with respect to outer races of the one or more bearings 124 and the support housing 122. In certain embodiments, the vanes 126 comprise a plurality of individual vane members that are each attached to the one or more bearings 124. In other embodiments, the vanes 126 are formed as an integral structure, for example as multiple vane structures machined or otherwise formed in a solid block of material. In certain embodiments, the bearings 124 are actively cooled, such as via a flow of liquid coolant which can include oil, engine coolant, and/or air conditioning refrigerant.

The support housing 122 defines a diameter $D_1$ at a first end and a second diameter $D_2$ at a second end thereof. In certain embodiments, the diameters $D_1$ and $D_2$ are substantially equal. In other embodiments, the diameters $D_1$ and $D_2$ differ such that the device 120 and support housing 122 define a choke or inward taper in one flow direction and an outward flaring configuration in the opposite direction so as to define a venturi. The relative sizing of the diameters $D_1$ and $D_2$, such as for relatively constant diameter, choked, and/or outward flaring venturis can be selected for the requirements of particular applications by one of ordinary skill.

FIG. 8 illustrates an alternative embodiment of a diverting vane 126' which may be utilized in a variation of the embodiment of flow adjuster 120 as illustrated in FIGS. 6 and 7. More particularly, the embodiment of vane 126' illustrated in FIG. 8 describes a generally curved and triangular configuration as opposed to the generally straight and rectangular configuration of vane 126. The vanes 126' would generally be also attached as multiple individual members or as an integral structure including multiple vanes 126' to an inner race of one or more bearings 124. The relative size, shape, and curvature of the vane 126' can be selected to achieve appropriate swirl and flow dampening characteristics appropriate to a particular application by one of ordinary skill.

The vanes 126 are also preferably provided with tapering or beveling 127 on leading and trailing edges of the vanes 126 to reduce drag on the fuel/air mixture flowing across the vanes 126. The vanes 126 are also angled or tilted with respect to a central axis coincident with the center 128 of the support housing 122, such that air or other flow through the interior of the flow adjuster 120 impinges upon angled faces 130 of the vanes 126. The angle of attack of the vanes 126 as well as their number and pitch can also be selected for the requirements of particular applications by one of ordinary skill. Thus, this incoming flow will induce the vanes 126, as attached to the inner races of the bearing 124, to create a rotating mass 132. The rotating mass 132 has a non-negligible rotational inertia which serves to attenuate or dampen fluctuations in flow through the intake tract 106.

Figure 9:
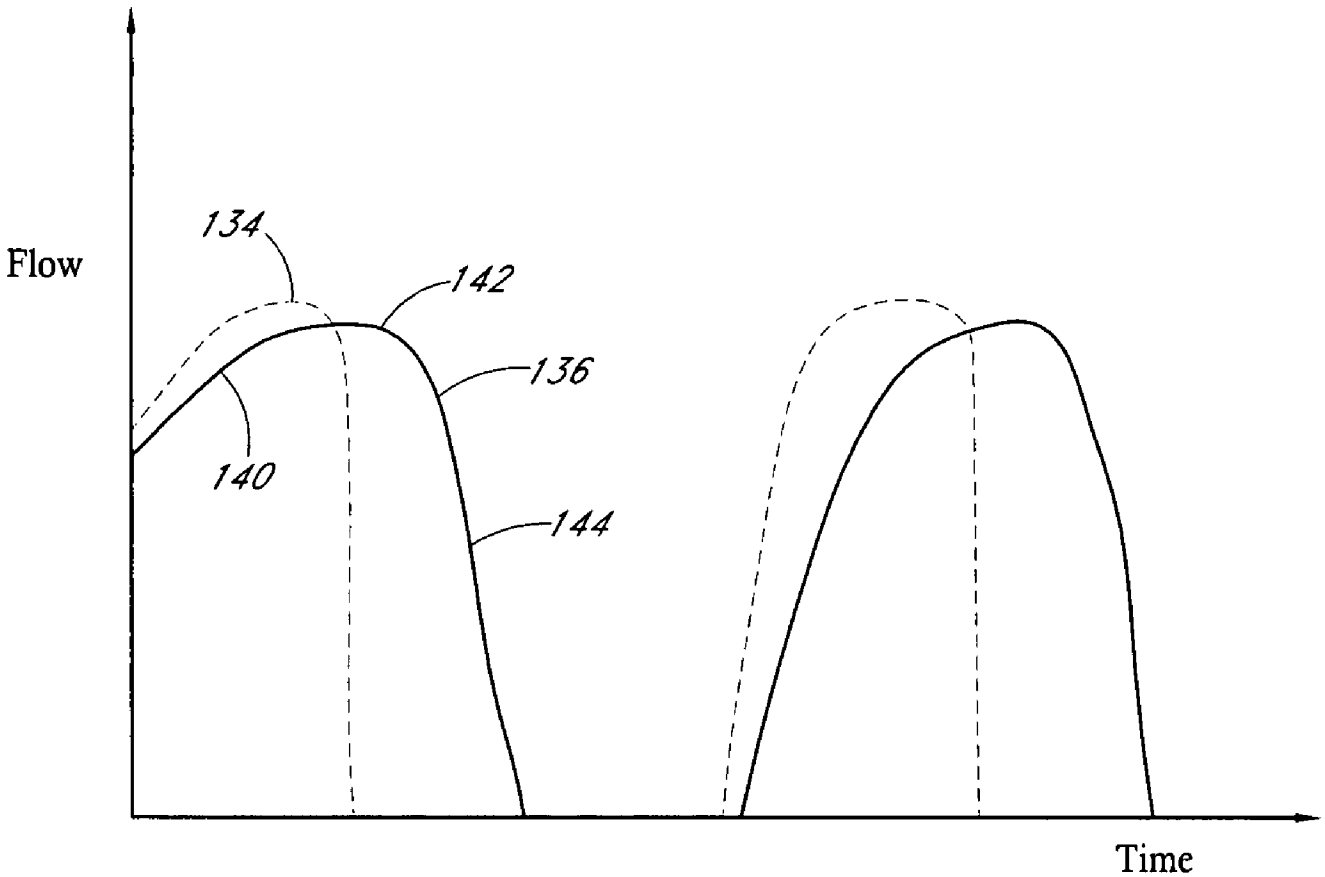
FIG. 9 is a graph of flow characteristics over time in a typical conventional engine and according to embodiments of the invention.

For example, as indicated in FIG. 9, a conventional flow 134 in conventional internal combustion engine systems not provided with one or more of the embodiments of the invention described herein, typically undergoes a non-uniform pulsed characteristic over time. More particularly, the operation of the intake cycle of an internal combustion engine periodically exposes the intake tract to periods of relatively strong engine vacuum (and corresponding flow) with interposed periods of significantly reduced engine vacuum and flow. These characteristics of conventional flow 134 arise due to the intake strokes throughout the operating combustion cycle of the internal combustion engine and may be further influenced by the relative timing of opening and closing of one or more intake and exhaust valves.

In contrast, in various embodiments of the fuel vaporization system 100 including one or more of the flow adjusters 120, during the repeated intake cycles wherein flow through the intake tract 106 and through the one or more flow adjusters 120 occurs, flow proceeds generally as indicated by the adjusted flow 136 shown in FIG. 9. More particularly, during the onset of an intake cycle, as the fuel air mixture flows through the one or more flow adjusters 120, it will be incident on the plurality of angled faces 130 of the vanes 126. This angled or vectored impact will convert a portion of the kinetic energy of the fuel air mixture flow to a circumferential force about the center 128 which will tend to accelerate the rotating mass 132. As the rotating mass 132 has a non-negligible rotational inertia, this tends to result in a dampened flow increase indicated as 140 in FIG. 9. The dampened flow increase 140 is characterized generally by a reduced rate of increase of the adjusted flow 136, a somewhat lower peak flow as compared to an otherwise conventional flow 134, and a peak 142 which occurs somewhat delayed from a peak of an otherwise conventional flow 134 or occurring somewhat later in time.

The rotating mass 132 also tends to attenuate or dampen a flow decrease 144 of the adjusted flow 136. More particularly, the rotational inertia of the rotating mass 132 will tends to maintain the rotation of the rotating mass 132 absent the circumferential force provided by impact of an incoming fuel air mixture on the angled faces 130. With a conventional flow 134, the flow into and through an intake tract tends to sharply drop off once the intake cycle is completed, such as by closure of one or more intake valves. In contrast, the rotating mass 132 will tend to keep spinning after the cessation of the intake cycle such that the dampened flow decrease 144 is characterized generally by a less steep and elongated fall-off of flow through the flow adjuster 120 as compared to an otherwise conventional flow 134.

Thus, the adjusted flow 136 exhibits characteristics that are more moderated and uniform than a conventional flow 134. The physical forces arising from the alternating acceleration and deceleration of the rotating mass 132 through repeated intake cycles further contributes to generation of a swirling flow about the swirl axis S as well as providing an extending duration wherein the flow adjuster 120 is active on the fuel air mixture. This has been found to further assist in more complete itemization or vaporization of liquid fuel particles which may occur in the fuel air mixture flow.

Figure 11:
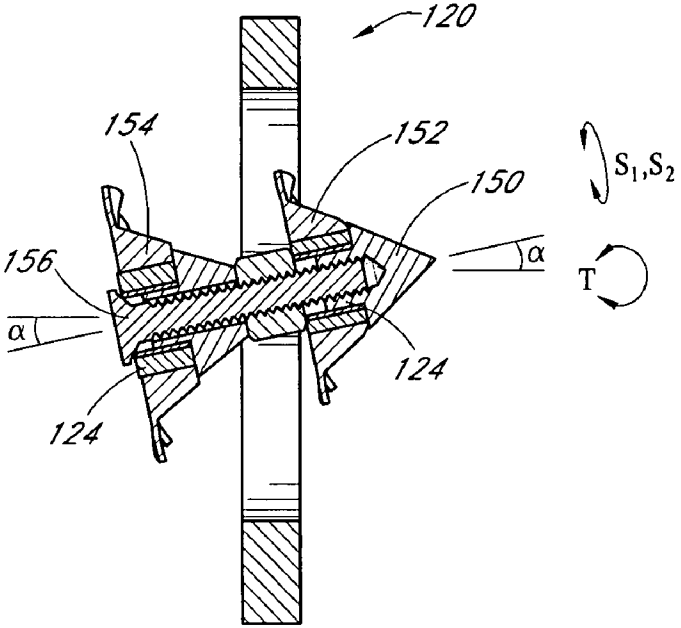
FIGS. 10 and 11 are perspective and side section views respectively of one embodiment of a fuel vaporization device.
Figure 10:
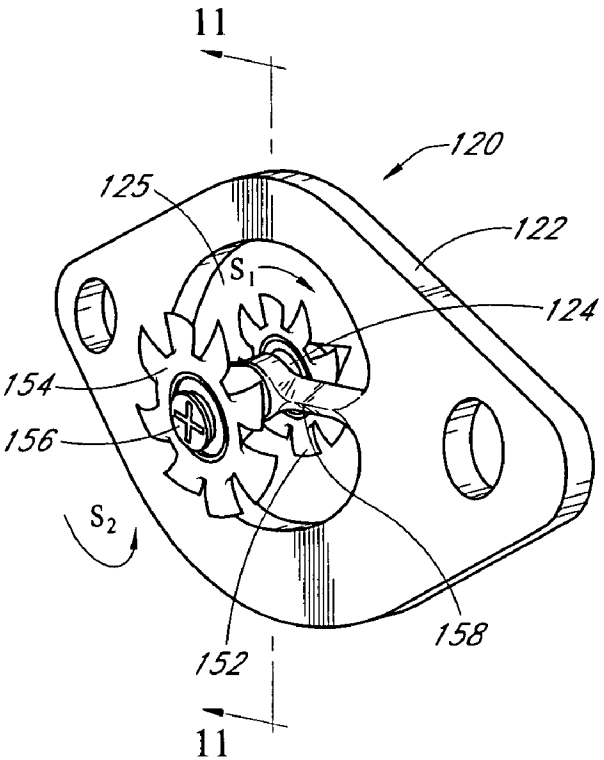

FIGS. 10 and 11 illustrate in perspective and side section views respectively another embodiment of flow adjuster 120. In this embodiment, the flow adjuster 120 comprises a support housing 122 which is configured generally as a flange shaped structure. In this embodiment, the support housing 122 also defines a center web 158 and a central opening 125. The support housing 122 is further configured to be attached at an end of an intake tract 106 comprising either individual runners 110 or a manifold structure 112. In one particular embodiment, the support housing 122 is configured to be interconnected between the end of the intake tract 106 and the internal combustion engine 102 as illustrated in FIG. 1. In this embodiment, the flow adjuster 120 comprises a first flow diverter 150, a second flow diverter 152, and a third flow diverter 154. The first, second, and third flow diverters 150, 152, 154 are attached to a generally centrally or axially positioned axle or shaft 156. The first flow diverter 150 is attached at a first end of the axle or shaft 156 and the third flow diverter 154 is attached at the opposite end of the axle or shaft 156. The second flow diverter 152 is positioned between or intermediate the first flow diverter 150 and third flow diverter 154. The second and third flow diverters 152, 154 are further attached to the axle or shaft 156 via corresponding bearings 124 such that each of the second and third flow diverters 152, 154 are free to independently rotate with respect to each other and with respect to the first flow diverter 150 and the axial or shaft 156.

The axle or shaft 156 as well as the first, second, and third flow diverters 150, 152, and 154 are attached to a center web 158 of the support housing 122. The center web 158 has a generally airfoil shaped cross-section to reduce drag on the air/fuel mixture flowing past the center web 158 and to reduce stagnation zones for the flow. The axle 156 is also arranged at an angle $\alpha$ with respect to a major plane of the support housing 122. Thus, in this embodiment, the flow adjuster 120 can be installed in a relatively straight portion of an intake tract 106 and a single flow adjuster 120 of the embodiments illustrated in FIGS. 10 and 11 can provide both the swirling component S as well as the tumbling component T to a through going fuel air flow as illustrated in FIG. 5.

In certain embodiments, the second flow diverter 152 is configured to induce a first swirling motion in a first direction indicated as $S_1$ and the third flow diverter 154 is configured to induce a second swirl motion opposite in direction to the first swirl motion $S_1$, the second swirl direction indicated as $S_2$. Thus, in this embodiment, the second flow diverter 152 and third flow diverter 154 induce counter rotating or opposed swirl motions to a through going flow. In other embodiments, the second and third flow diverters 152, 154 are configured to both induce swirl in substantially the same direction either $S_1$ or $S_2$.

Figure 12:
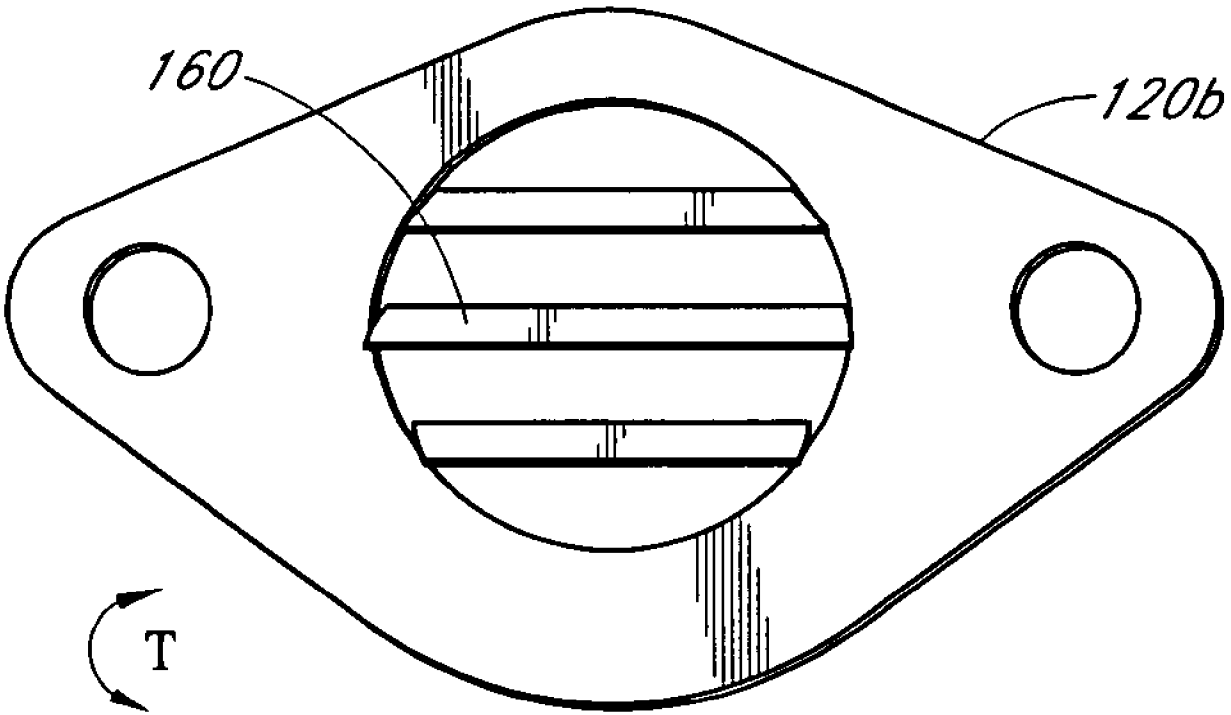
FIG. 12 is a front view of another embodiment of a fuel vaporization device.

FIG. 12 is a perspective view of another embodiment of a fixed flow adjuster 120. In this embodiment, the fixed flow adjuster 120 comprises a plurality of angled vanes 160. In this embodiment, incoming fuel air mixture strikes the angled vanes 160 which induces a tumbling motion component T. The vanes 160 can be angled at different angles depending on the requirements of particular applications, however vanes 160 arranged at angles of approximately 5° to 45° have been found to provide advantageous results.

Thus, various embodiments of the flow adjuster 120 of the fuel vaporization system 100 provide active or moving flow adjustment to fuel air mixtures passing through the intake tract 106 and thus through the one or more flow adjusters. This provides advantages over conventional flows dependent on passive components which lack the ability to actively adjust flow after cessation, for example, of an intake cycle. Further, various embodiments of the system 100 induce at least a swirling or a tumbling component to a fuel air mixture flow. Certain embodiments combine these effects to provide both a swirling and a tumbling component to further facilitate more complete atomization or vaporization of liquid fuel in the air. Various embodiments are suitable for systems having one or a plurality of individual intake runners 110 as well as to monolithic or integral manifold 112 type intake tracts 106. In yet other embodiments, two or more flow adjusters 120 can provide both swirling and tumbling flow wherein a first flow adjuster 120*a* provides the swirling component and a second flow adjuster 120*b* provides a tumbling component. In one particular embodiment, this tumbling component is provided by a plurality of angled blades 160 which are arranged to induce the tumbling component T generally transverse to the swirl axis S.

Various embodiments of the system 100 can be provided either as original equipment at time of manufacture or as a readily installable aftermarket add-on option. This provides the flexibility of retrofitting the system 100 to existent vehicles to obtain the previously described benefits. The flow adjusters 120 are preferably made with relatively durable and heat resistant materials, such as steel, aluminum alloys, titanium alloys, or other corrosion and temperature resistant materials for extending durability in the environment of an internal combustion engine 102.

Although the above disclosed embodiments of the present teachings have shown, described and pointed out the fundamental novel features of the invention as applied to the above-disclosed embodiments, it should be understood that various omissions, substitutions, and changes in the form of the detail of the devices, systems and/or methods illustrated may be made by those skilled in the art without departing from the scope of the present teachings. Consequently, the scope of the invention should not be limited to the foregoing description but should be defined by the appended claims.

What is claimed is:

1. A flow adjuster for an internal combustion engine comprising:

a support housing having an outer surface configured to be connected with an intake tract of an internal combustion engine;

at least one annular bearing having an outer race which is attached to an inner surface of the support housing, the at least one bearing also having an inner race; and a plurality of vanes extending inwardly from the inner race and arranged so as to define a plurality of angled faces and wherein the plurality of vanes and the inner race together define a rotating mass having a rotational inertia and wherein a flow of a fuel and air mixture through a central opening of the support housing will impinge on the plurality of angled faces so as to provide a rotational acceleration of the rotating mass to improve vaporization of the fuel in the fuel and air mixture.

2. The flow adjuster of claim 1, wherein the plurality of angled vanes comprise rectangular members which are attached to the inner races at an angle with respect to a longitudinal axis of the support housing.

3. The flow adjuster of claim 1, wherein rotational inertia of the rotating mass attenuates fluctuations in the fuel and air mixture flow.

4. The flow adjuster of claim 1, wherein the plurality of vanes comprises curved structures having a curvature defining the angled faces.

5. The flow adjuster of claim 1, wherein the support housing has a substantially constant diameter.

6. A flow adjuster for an internal combustion engine comprising:

a support housing configured to be connected with an intake tract of an internal combustion engine along a flow axis and defining an opening with a center web configured to extend across the opening;

an axle mounted to the center web, and arranged to be generally aligned with the flow axis and inclined with respect to the flow axis such that the flow adjuster also provides a tumble component to the flow to further improve vaporization of the fuel in the fuel and air mixture;

at least one bearing mounted to the axle; and at least one rotatable flow diverter connected via the at least one bearing to the axle wherein a flow of a fuel and air mixture through the opening of the support housing will provide a rotational acceleration of the rotating mass and a swirling component to the flow to improve vaporization of the fuel in the fuel and air mixture.

7. The flow adjuster of claim 6, comprising a plurality of flow diverters connected to the axle.

8. The flow adjuster of claim 7, wherein the plurality of flow diverters are independently rotatable from each other.

9. The flow adjuster of claim 8, wherein the plurality of flow adjusters are configured to counter-rotate with respect to each other.

* * * * *